US011950704B2

(12) United States Patent
McGuire et al.

(10) Patent No.: US 11,950,704 B2
(45) Date of Patent: Apr. 9, 2024

(54) BEDDING COMPONENTS INCLUDING A CONVOLUTED FOAM LAYER

(71) Applicant: DREAMWELL, LTD., Doraville, GA (US)

(72) Inventors: Sheri L. McGuire, Duluth, GA (US); Lindsey Beth Sidrane Sieber, Atlanta, GA (US)

(73) Assignee: DREAMWELL, LTD., Doraville, GA (US)

( * ) Notice: Subject to any disclaimer, the term of this patent is extended or adjusted under 35 U.S.C. 154(b) by 51 days.

(21) Appl. No.: 17/510,889

(22) Filed: Oct. 26, 2021

(65) Prior Publication Data

US 2023/0127744 A1 Apr. 27, 2023

(51) Int. Cl.
*A47C 27/14* (2006.01)
*A47C 27/15* (2006.01)

(52) U.S. Cl.
CPC ..... *A47C 27/148* (2013.01); *A47C 27/15* (2013.01)

(58) Field of Classification Search
CPC ..... A47C 27/148; A47C 27/15; A47C 27/142; A47C 27/144; A47C 27/146
See application file for complete search history.

(56) References Cited

U.S. PATENT DOCUMENTS

| | | | | |
|---|---|---|---|---|
| D524,585 | S * | 7/2006 | Contreras | D6/606 |
| 2010/0218318 | A1* | 9/2010 | Steppat | A47C 27/144 267/142 |
| 2013/0152305 | A1* | 6/2013 | Lall | A47C 27/127 5/400 |
| 2014/0059776 | A1* | 3/2014 | Romero | A47C 27/15 5/655.9 |
| 2019/0038043 | A1* | 2/2019 | Fisher | A47C 27/20 |
| 2019/0365116 | A1* | 12/2019 | Roma | A47C 27/148 |
| 2021/0022520 | A1* | 1/2021 | Gladney | A47C 27/144 |
| 2022/0346566 | A1* | 11/2022 | Oh | A47C 27/002 |

* cited by examiner

*Primary Examiner* — Justin C Mikowski
*Assistant Examiner* — Alison N Labarge
(74) *Attorney, Agent, or Firm* — CANTOR COLBURN LLP

(57) ABSTRACT

Mattress toppers for mattress assemblies and pillowtop mattress assemblies generally includes a convoluted foam layer including a convoluted upper surface and a bottom planar surface. The convoluted foam layer includes a convoluted upper surface and a bottom planar surface. The convoluted upper surface comprising repeating geometric depressions defined by an outer geometric-shaped outer wall and a concentric shaped inner wall. The geometric depression can be defined by a geometric outer wall, e.g., hexagonally shaped, and a concentric inner wall, e.g., circular shaped.

20 Claims, 3 Drawing Sheets

BEDDING COMPONENTS INCLUDING A CONVOLUTED FOAM LAYER

BACKGROUND

The present disclosure generally relates to a bedding components including a convoluted foam layer.

Conventional mattresses include metal coil springs, which are known to provide the mattress assembly with independent pressure point relief along the sleeper's body. The coils are typically provided within an inner core, which underlies one or more foam layers. A mattress topper or pillowtop is typically positioned between the mattress and a bed sheet. Mattress toppers typically are filled with foam or fiber layers.

BRIEF SUMMARY

The present disclosure is directed to mattress topper including a convoluted foam layers for mattress assemblies. In one or more embodiments, a mattress topper includes a convoluted foam layer comprising a convoluted upper surface and a bottom planar surface, the convoluted upper surface comprising repeating geometric depressions defined by an outer geometric-shaped outer wall and a concentric shaped inner wall.

In one or more embodiments, a mattress topper includes a convoluted foam layer comprising a convoluted upper surface and a bottom planar surface, the convoluted upper surface comprising a plurality of depressions in the convoluted foam layer, wherein each of the plurality of depressions is defined by a hexagonally shaped outer wall and a circular-shaped inner wall, wherein the plurality of depressions are separated from each other by a space, wherein space comprises a planar contact surface; and at least one overlying foam layer comprising a bottom planar surface in contact with a planar contact surface defined by the space between the plurality of depressions.

In one or more embodiments, a pillowtop mattress includes a pillowtop portion comprising a convoluted foam layer comprising a convoluted upper surface and a bottom planar surface, the convoluted upper surface comprising a plurality of depressions in the convoluted foam layer, wherein each of the plurality of depressions is defined by a hexagonally shaped outer wall and a circular inner wall, wherein the plurality of depressions are separated from each other by a space, wherein space comprises a planar contact surface.

The disclosure may be understood more readily by reference to the following detailed description of the various features of the disclosure and the examples included therein.

BRIEF DESCRIPTION OF THE SEVERAL VIEWS OF THE DRAWINGS

Referring now to the figures wherein the like elements are numbered alike.

DETAILED DESCRIPTION

Figure 1:
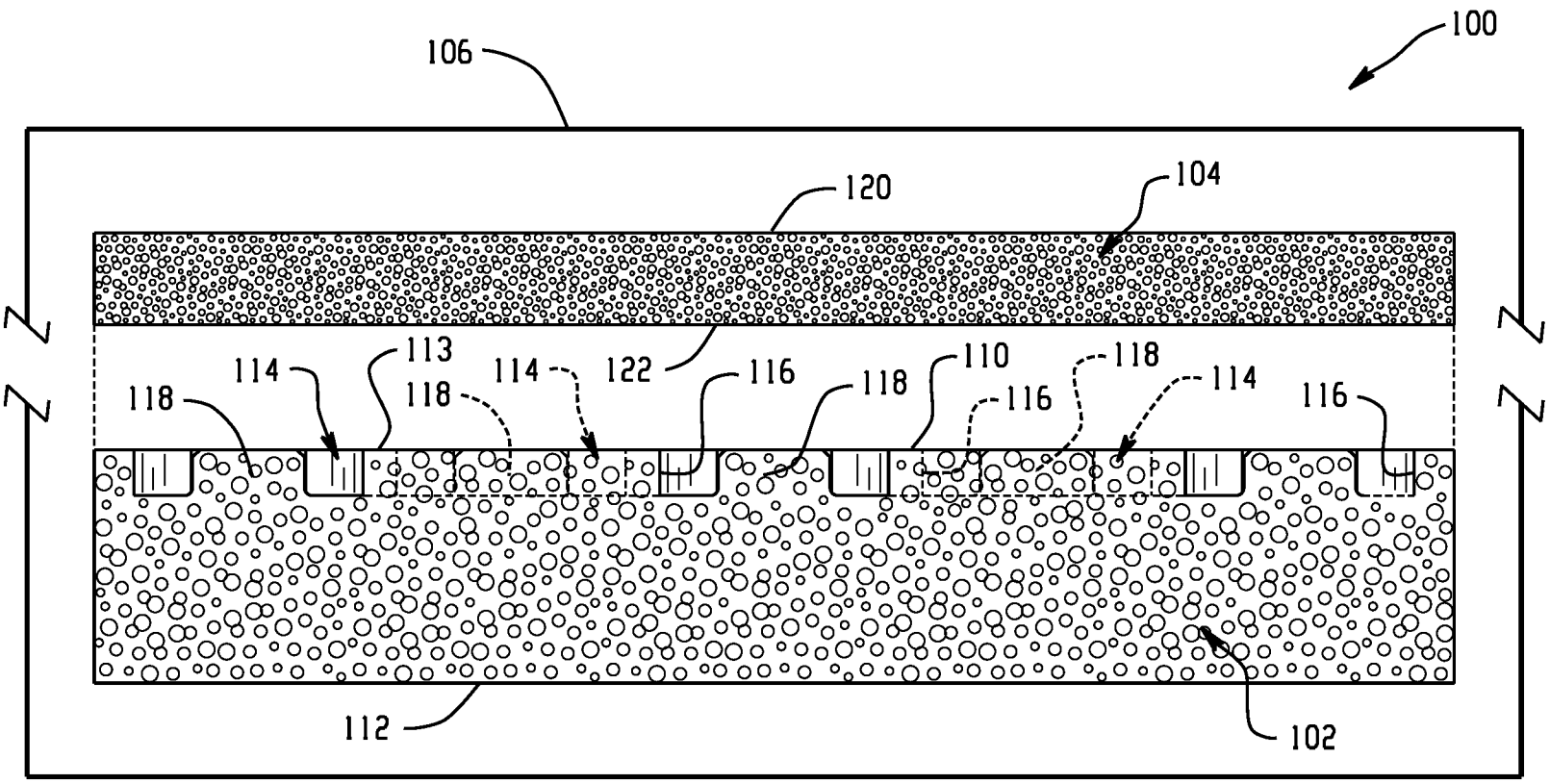
FIG. 1 depicts an exploded cross-sectional view of a mattress topper including a convoluted foam layer in accordance with the present disclosure.

Disclosed herein is a mattress topper for use in mattress assemblies, wherein the mattress topper generally includes a convoluted foam layer and at least one foam layer overlying the convoluted foam layer, wherein the at least one foam layer has planar top and bottom surfaces, and wherein the convoluted foam layer and the at least one overlying foam layer are optionally encased in a fabric covering. The convoluted foam layer includes a convoluted surface and a bottom planar surface. In one or more embodiments, the convolutions in the convoluted foam layer face upwards towards the end user contact surface, i.e., the sleeping surface.

The mattress topper including the convoluted foam layer generally has a length and width dimension that is substantially the same as the underlying mattress, wherein the length dimension, also referred to herein as the longitudinal axis, is greater than the width dimension. The convoluted surface is defined by repeating geometrically patterned depressions in an upper surface of the foam layer, wherein each of the repeating geometrically patterned depressions is defined by an geometric shaped outer wall such and a concentric-shaped inner wall. In this manner, the convoluted foam layer has a relatively large planar contact area in portions of the foam layer between the geometrically patterned depressions, wherein the inner portion of the convolution may or may not be coplanar to the top surface and may or may not be uniform or level. Although reference will be made to repeating hexagonally patterned depressions including an hexagonal-shaped outer wall, other geometric shapes can be employed, e.g., octagon, heptagonal, pentagonal, square, triangular, and the like. Likewise, the concentric-shaped inner wall can have a circle shape, an elliptical shape, an oblong-shape, and the like. In other embodiments, the inner wall is not concentric.

In one or more embodiments, multiple columns of the repeating geometrically patterned depressions are arranged in a staggered, i.e., offset, relationship relative to adjacent columns. Still further, in other embodiments, multiple columns of the repeating geometrically patterned depression are random. In still other embodiments, different repeating geometrically patterned depressions can be provided to define different zones within the surface of the foam layer.

As will be described in greater detail below, advantageously, the presence of the repeating geometrically patterned depressions in the convoluted foam layer provides pressure point relief to enhance sleeper comfort. The repeating geometrically patterned depressions provides hundreds of pressure-relieving cutouts per mattress topper, which allows for hundreds of individual points of pressure relief. Unlike the mattress topper of the present disclosure, current convoluted foams are often developed for their feel rather than their benefit. Additionally, the relatively large planar contact surface between the uppermost planar surface between depressions in the convoluted foam layer provides increased contact surface area for adhesion to the at least one overlying foam layer within the mattress topper assembly.

As used herein, the mattress topper is generally defined as a layer that sits on top of a mattress to provide cushioning and support. In one or more embodiments, the mattress topper is removable. In one or more other embodiments, the mattress topper is provided as a pillowtop portion in a pillowtop mattress assembly.

For the purposes of the description hereinafter, the terms "upper", "lower", "top", "bottom", "left," and "right," and derivatives thereof shall relate to the described structures, as they are oriented in the drawing figures. The same numbers in the various figures can refer to the same structural component or part thereof. Additionally, the articles "a" and "an" preceding an element or component are intended to be nonrestrictive regarding the number of instances (i.e. occurrences) of the element or component. Therefore, "a" or "an" should be read to include one or at least one, and the singular word form of the element or component also includes the plural unless the number is obviously meant to be singular.

Spatially relative terms, e.g., "beneath," "below," "lower," "above," "upper," and the like, can be used herein for ease of description to describe one element or feature's relationship to another element(s) or feature(s) as illustrated in the figures.

The following definitions and abbreviations are to be used for the interpretation of the claims and the specification. As used herein, the terms "comprises," "comprising," "includes," "including," "has," "having," "contains" or "containing," or any other variation thereof, are intended to cover a non-exclusive inclusion. For example, a composition, a mixture, process, method, article, or apparatus that comprises a list of elements is not necessarily limited to only those elements but can include other elements not expressly listed or inherent to such composition, mixture, process, method, article, or apparatus.

As used herein, the term "about" modifying the quantity of an ingredient, component, or reactant of the invention employed refers to variation in the numerical quantity that can occur, for example, through typical measuring and liquid handling procedures used for making concentrates or solutions. Furthermore, variation can occur from inadvertent error in measuring procedures, differences in the manufacture, source, or purity of the ingredients employed to make the compositions or carry out the methods, and the like.

It will also be understood that when an element, such as a layer, region, or substrate is referred to as being "on" or "over" another element, it can be directly on the other element or intervening elements can also be present. In contrast, when an element is referred to as being "directly on" or "directly over" another element, there are no intervening elements present, and the element is in contact with another element.

Referring to FIG. 1, there is depicted an exploded cross-sectional view of an exemplary mattress topper generally designated by reference numeral 100 including a convoluted foam layer 102 and at least one overlying foam layer 104 in accordance with the present disclosure. The convoluted foam layer 102 and the at least one overlying foam layer 104 are encased in a fabric 106.

The convoluted foam layer 102 generally includes a convoluted upper surface 110 and a bottom planar surface 112. The convoluted surface 110 includes a planar surface 113 and a plurality of geometrically patterned depressions 114 formed in the planar surface 113. As shown more clearly in FIGS. 2-3, in one or more embodiments, the depressions 114 are defined by a hexagonal-shaped outer wall 116 and a circular-shaped inner wall 118. The depressions 114 are arranged offset in columns and rows across the convoluted surface so as to maximize the number of pressure points in the convoluted surface per unit area. That is, a depression in one column is offset by about 45 degrees relative to the depression in an adjacent column. In one or more embodiments, the depressions 114 in one columns and rows. In one or more other embodiments, the depressions are arranged randomly. In still one or more other embodiments, different zones within the convoluted surface include depressions defining two or more zones of different configurations and/or different size depressions.

The overlying foam layer 104 includes top and bottom planar surfaces 120, 122, respectively. The convoluted foam layer 102 is adhesively affixed to the overlying foam layer 104. The uppermost planar surface 113 of the convoluted foam layer 102 provides a planar contact surface with the bottom planar surface 122 of the overlying foam layer 104.

The optional fabric covering 106 can be any desired sheet of material, such as cotton, linen, synthetic fibers or a mixture thereof. The fabric covering can be quilted or non-quilted. Additionally, the fabric covering 106 can include additional layers such as a flame-retardant layer and/or backing layers (not shown). The various layers can be fixedly attached to one another by stitching, an adhesive, or the like to define a panel, which can be removable or non-removable, or can be individual layers.

Figure 2:
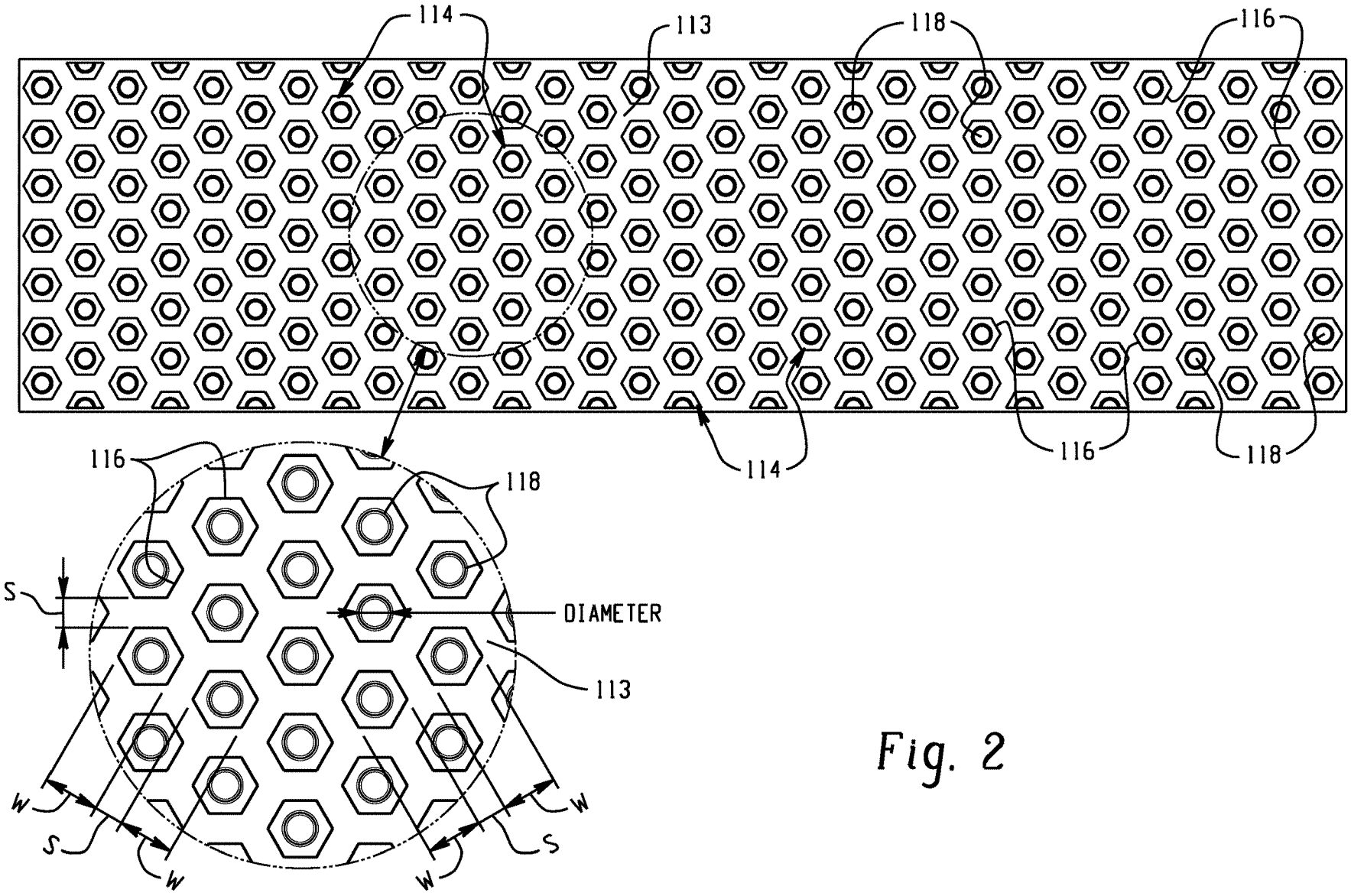
FIG. 2 is a top-down view and an enlarged view of a convoluted foam layer in accordance with the present disclosure.

As shown more clearly in the top-down view provided in FIG. 2 of the convoluted foam layer 102, the convoluted foam layer 102 includes a convoluted surface including a plurality of spaced apart depressions 114, wherein each depression is defined by defined by a hexagonal-shaped outer wall 116 and a circular-shaped inner wall 118.

In one or more embodiments, the hexagonal-shaped outer wall 116 has a width dimension (W) from one sidewall of the hexagonal-shaped outer wall to an opposing parallel sidewall is from about 1 inch to about 6 inches; in one or more other embodiments, the hexagonal-shaped outer wall 116 has a width dimension from one sidewall of the hexagonal-shaped to an opposing parallel sidewall is from about 1 inch to about 3 inches; and in still one or more other embodiments, the hexagonal-shaped outer wall 116 has a width dimension from one sidewall of the hexagonal-shaped to an opposing parallel sidewall is from about 1.5 inches to about 2 inches.

The spacing (S) between adjacent hexagonal-shapes measured from one sidewall of the hexagonal-shaped outer wall to a proximate parallel sidewall of the adjacent hexagonal shaped outer wall when viewed from the top down is from about 0.25 inches to about 4 inches; in one or more other embodiments, the spacing from one sidewall of the hexagonal-shaped outer wall to a proximate parallel sidewall of an adjacent hexagonal-shaped outer wall when viewed from the top down is from about 0.50 inches to about 2 inches; and in still one or more other embodiments, the spacing from one sidewall of the hexagonal-shaped outer wall to a proximate parallel sidewall of an adjacent hexagonal-shaped outer wall when viewed from the top down is from about 0.50 inches to about 1 inches.

The circular inner wall 118 forms a cylindrical shape in the convoluted surface, wherein each cylindrical shaped foam body provides independent pressure point relief. In one or more embodiments, the circular inner wall 118 provides a diameter when viewed from the top down of about 0.25 inches to about 6 inches; in one or more other embodiments, the circular inner wall 118 provides a diameter when viewed from the top down of about 0.5 inches to about 3 inches; and ins till one or more other embodiments, the circular inner wall 118 provides a diameter when viewed from the top down of about 0.5 inches to about 1.25 inches.

The mattress topper can be sized for any mattress assembly including standard sizes such as a twin, queen, oversized queen, king, or California king sized mattress, as well as custom or non-standard sizes constructed to accommodate a particular user or a particular room. By way of example, the mattress topper could be a smaller mattress designed for a child or baby. Such a mattress may be part of a crib or cradle.

The thickness of the convoluted foam layer 102 can generally range from about 0.5 inch to about 8 inches. The depth of the depressions as measured from the uppermost planar surface of the convoluted foam layer 102 to the lowermost surface in the depression will generally depend on the thickness of the convoluted foam layer. In one or more embodiments, the depth is about 75 percent of the overall thickness of the convoluted foam layer; in one or more other embodiments, the depth is about 50 percent of the overall thickness of the convoluted foam layer; and in still one or more other embodiments, the depth is about 25 percent of the overall thickness of the convoluted foam layer. In one or more embodiments, the depth of the depressions is uniform throughout the convoluted foam layer. In one or more other embodiments, the depth of the depressions is non-uniform.

The individual layers 102, 104 can be fixedly attached to one another by any means including, but not limited to, application of hot or cold adhesives, and the like.

Suitable foams for the different layers 102, 104 include, but are not limited to, polyurethane foams, latex foams including natural, blended and synthetic latex foams; polystyrene foams, polyethylene foams, polypropylene foam, poly ether-polyurethane foams, and the like. Likewise, a selected one or more of the foam layers in the mattress topper can be selected to be viscoelastic or non-viscoelastic foams. Some viscoelastic materials are also temperature sensitive, thereby also enabling the convoluted foam layer to change shape based in part upon the temperature of the supported part. Any of these foams may be open celled or closed cell or a hybrid structure of open cell and closed cell. Likewise, the foams can be reticulated or partially reticulated or non-reticulated. Still further, the foams may be gel infused in some embodiments. The term reticulation generally refers to removal of cell membranes to create an open cell structure that is open to air and moisture flow. The different layers can be formed of the same material configured with different properties or different materials.

Figure 3:
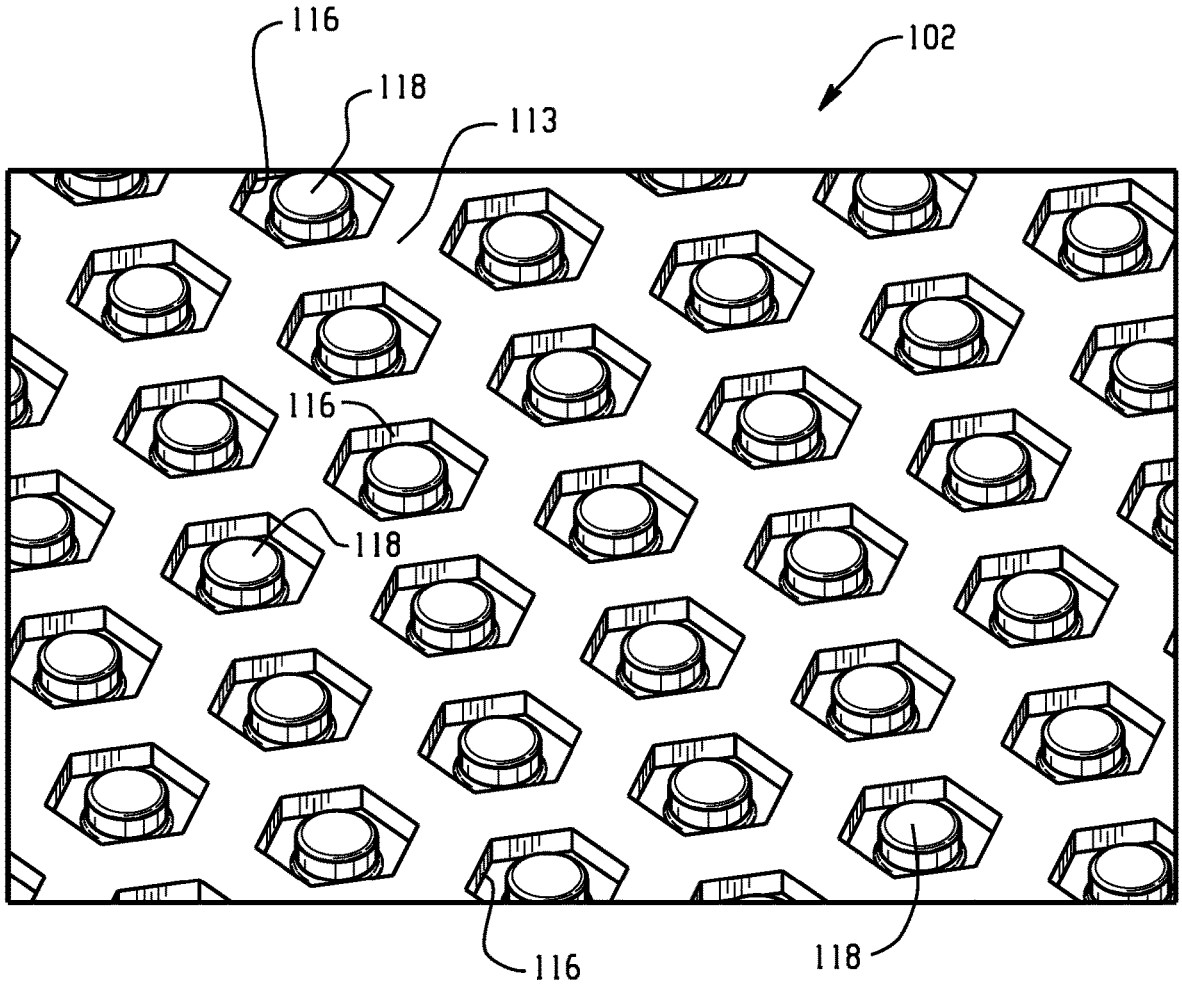
FIG. 3 is a partial perspective view of a convoluted foam layer in accordance with the present disclosure.

FIG. 3 pictorially illustrates a top perspective view portion of an exemplary convoluted foam layer 102 constructed of polyurethane foam. As shown, the depressions 114 are spaced apart from another to provide a planar surface 113 therebetween, which can be used to provide a contact surface for affixing the convoluted foam layer to the bottom planar surface of an overlying foam layer. The inner circular shape 118 defines a cylindrical foam body including a top planar surface, which can be used to further increase the contact surface By way of example of a mattress topper construction including different materials, the convoluted foam layer can be a latex foam and the overlying foam layer can be a polyurethane foam, or vice versa. In another example, the convoluted foam layer can be a viscoelastic foam layer and the overlying foam layer can be a non-viscoelastic foam layer, and vice versa. The particular combinations are not intended to be limited and are generally defined by the desired comfort and feel desired by the end user.

By way of example of a mattress topper construction including different properties, the convoluted foam layer and the overlying foam layer can be selected to have different hardness and/or density properties. In one or more embodiments, the thinner layer has a firmness greater than the thicker layer. In other embodiments, the thicker layer has a firmness greater than the thinner layer. In this manner, one of the first and second polymeric foam layers can be configured to have a soft feel and the other layer a firmer feel. The hardness of the layers generally has an indention load deflection (ILD) of 7 to 16 pounds force for viscoelastic foams and an ILD of 7 to 45 pounds force for non-viscoelastic foams. ILD can be measured in accordance with ASTM D 3575. The density of the layers can generally range from about 1 to 2.5 pounds per cubic foot for non-viscoelastic foams and 1.5 to 6 pounds per cubic foot for viscoelastic foams.

The various foams suitable for use in the convoluted foam layer 102 and/or the overlying foam layer 104 may be produced according to methods known to persons ordinarily skilled in the art. For example, polyurethane foams are typically prepared by reacting a polyol with a polyisocyanate in the presence of a catalyst, a blowing agent, one or more foam stabilizers or surfactants and other foaming aids. The gas generated during polymerization causes foaming of the reaction mixture to form a cellular or foam structure. Latex foams are typically manufactured by the well-known Dunlap or Talalay processes.

The different properties for each layer may include, but are not limited to, density, hardness, thickness, support factor, flex fatigue, air flow, various combinations thereof, and the like. Density is a measurement of the mass per unit volume and is commonly expressed in pounds per cubic foot. In one or more embodiments the convoluted foam layer 102 is formed of multiple layers of different properties. By way of example, the density of the convoluted foam layer 1-2 can vary. In some embodiments, the density decreases from the lower most layer to the upppermost layer. In other embodiments, the density decreases from peak to valley. In still other embodiments, the convoluted foam layer 102 is formed of three or more individual layers, wherein the density is random and is not characterized as a gradient. The hardness properties of foam are also referred to as the indention load deflection (ILD) or indention force deflection (IFD) and is measured in accordance with ASTM D-3574. Like the density property, the hardness properties can be varied in a similar manner. Moreover, combinations of properties may be varied for each individual layer defining the convolution. The individual layers defining the convolution can also be of the same thickness or may have different thicknesses as may be desired to provide different tactile responses.

By way of example, the convoluted foam layer 102 can be formed of the same polyurethane foam but have different densities or hardness for each layer, thereby providing a gradient density or gradient hardness within the convolution. In another example, the convoluted foam layer 102 can include a standard polyurethane foam layer and a viscoelastic layer so that the convolutions include a structurally heterogeneous layer of standard polyurethane and viscoelastic foam. The various combinations are practically limitless and provide the manufacturer with opportunities to tailor the tactile response to the end user.

The different foam layers, e.g., layers 102, 104, in the mattress topper generally have an ILD rating of about 1 to about 25 lbs. In one embodiment, one or more of the foam layers, 102, 104 may have an ILD rating of about 1 to about 4 lbs, about 1 to about 15 lbs. about 4 to about 15 lbs, about 4 to about 20 lbs, and about 20 to about 25 lbs. In one embodiment, one or more of the foam layers 102, 104 may have an ILD rating of about 11 lbs, an ILD rating less than about 11 lbs. or an ILD rating greater than about 11 lbs. In one embodiment, one or more of the foam layers 102, 104 may have an ILD rating that is about 2 to about 3 lbs greater than or less than the ILD rating of one or more of the other foam layers 102, 104. In one embodiment, one or more of the foam layers 102, 104 may have an ILD rating that is different or the same as the ILD rating of one or more of the other layers 102, 104.

In one embodiment, one or more of the foam layers 102, 104 may be infused with a gel material such as a polyurethane based gel. The gel material may comprise polyether or polyol. In one embodiment, the gel material may be formed by reacting a polyol with an isocyanate in the presence of a catalyst. The gel material may be in the form of particles or beads embedded in the foam layer 102, 104. The gel material may be a polymer such as elastomeric polymers, thermosetting polymers, thermoplastic elastomers, and combinations thereof. Suitable gels include polyurethane gels, silicone gels, PVC gels, polyorganosiloxane gels, polyol gels, polyisocyanate gels, and combinations thereof. The gel material 25 may provide additional support and/or increase the thermal conductivity of the foam layer to effectively remove or absorb the body heat of a user, thereby providing a cool or colder temperature support than a non-gel-infused layer. In one embodiment, one or more of the foam layers 102, 104 may have a thermal conductivity that is different or the same as the thermal conductivity of one or more of the other foam layers 102, 104. In one embodiment, one or more of the foam layers 102, 104 may include a layer of gel material laminated or disposed across substantially all or a portion of the upper surfaces of the foam layers. In one embodiment, one or more of the foam layers 102, 104 may include one or more gel discs or squares spaced across the upper surfaces of the foam layers.

The density of the layers can generally range from about 1 to about 2.5 pounds per cubic foot for non viscoelastic foams and 1.5 to 6 pounds per cubic foot for viscoelastic foams.

Optionally, the convoluted foam layer 102 and/or the overlying foam layer 104 can include a phase change material and/or a thermally conductive material. The phase change material (PCM) layer can be coated directly onto the desired foam layer.

PCMs generally operate on the principle that a material requires a relatively significant amount of energy (heat) to change from a solid to a liquid and then back from a liquid to a solid. PCMs can therefore absorb large amounts of heat or energy from their environment and return large amounts of heat to their environment. This effective absorption, store and release of heat can be used to help regulate the temperature of an environment.

In one or more embodiments, suitable PCMs include, without limitation, microencapsulated PCMs. Any of a variety of processes known in the art may be used to microencapsulate PCMs. One of the most typical methods which may be used to microencapsulate a PCM is to disperse droplets of the molten PCM in an aqueous solution and to form walls around the droplets using techniques such as coacervation, interfacial polymerization, or in situ polymerization, all of which are well known in the art. For example, the methods are well known in the art to form gelatin capsules by coacervation, polyurethane or polyurea capsules by interfacial polymerization, and urea-formaldehyde, urea-resorcinol-formaldehyde, and melamine formaldehyde capsules by in situ polymerization.

PCMs can then be dispersed in a liquid vehicle such as a gel and applied to the above noted foam surfaces.

Encapsulation of the PCM creates a tiny, microscopic container for the PCM. This means that regardless of whether the PCM is in a solid state or a liquid state, the PCM will be contained. The size of the microcapsules typically ranges from about 1 to about 100 microns and more typically from about 2 to about 50 microns. The capsule size selected will depend on the application in which the microencapsulated PCM is used.

The microcapsules will typically have a relatively high payload of phase change material, typically at least 70% by weight, more typically at least 80% by weight, and in accordance with some embodiments, the microcapsules may contain more than 90% phase change material.

Gelling agents useful in the present disclosure include polysaccharides, nonionic polymers, inorganic polymers, polyanions and polycations. Examples of polysaccharides useful in the present disclosure include, but are not limited to, alginate and natural ionic polysaccharides such as chitosan, gellan gum, xanthan gum, hyaluronic acid, heparin, pectin and carrageenan. Examples of ionically crosslinkable polyanions suitable for use in the practice of the present invention include, but are not limited to, polyacrylic acid and polymethacrylic acid. Ionically crosslinkable polycations such as polyethylene imine and polylysine are also suitable for use in the present invention. A specific example of a non-ionic polymer is polyvinylalcohol. Sodium silicates are examples of useful inorganic polymers.

The gelling agents are typically provided as an aqueous solution at a concentration and viscosity sufficient to provide the desired amount of coating on the microcapsules. The technology of microencapsulation is known to those skilled in the art as is the routine optimization of these parameters for the gelling agent.

The microencapsulated PCM can be dispersed in a liquid vehicle such as a gel and applied to a surface of the substrate. The surface application can be applied by coating, spray coating, or the like. The particular application method is not intended to be limited.

The particular PCM is not intended to be limited and can be inorganic or organic. Suitable inorganic PCMs include salt hydrates made from natural salts with water. The chemical composition of the salts is varied in the mixture to achieve required phase-change temperature. Special nucleating agents can be added to the mixture to minimize phase-change salt separation. Suitable organic PCMs include fatty acids, waxes (e.g., paraffins) or the like.

In still other embodiments, one of the convoluted foam layer and/or the one or more overlying layers can include thermally conductive fillers by themselves or in addition to the PCM. Thermally conductive fillers such as various fibers, powder, flakes, needles, and the like can be dispersed within the foam matrix. In one embodiment, the thermally conductive fillers are nanoparticles with at least one dimension that measures 1,000 nanometers or less, e.g., nanowires, and nanostrands.

The thermally conductive fillers can be formed of metals, metal oxides, polymers, inorganic compounds and the like. By way of example, suitable materials may be made of carbon, graphene, graphite, platinum, aluminum, diamond, gold, silver, silicon, copper, iron, nickel, and the like; polymers such as stretched polyethylene nanofibers; and the like, and mixtures thereof. In most embodiments, the selected material has a thermal conductivity greater than 10 watts per meters-Kelvin (W/m*K). By way of example, aluminum has a thermal conductivity of about 235 W/m*K; stretched polyethylene fibers is estimated to be about 180 W/m*K, and graphene has a theoretical conductivity of about 5000 W/m*K.

The foams can also include one or more various additives depending on the intended application including dyes, pigments, intumescent compounds, fire retardants, antimicrobials, fragrants, emulsifiers, preservatives, humectants, surfactants, hydrophilic agents, hydrophobic agents, and the like.

The particular process for forming the convoluted foam layer is not intended to be limited. An exemplary process of manufacturing the convoluted foam layer in accordance with the present disclosure generally includes introducing the foam layer having a longitudinal dimension between a pair of counter rotating drums, at least one of which has a convoluted surface. As the foam layer is drawn between the drums, the convolutions present on the surface of at least one of the rotating drums compresses the foam layer to a greater or lesser degree depending on the locations of the convolutions on the drum. A heated wire or blade is held generally parallel to and between the drums such that the foam layer is cut generally mirroring the convolutions on the surface of the drum. That is, where a drum convolution compresses the foam layer in the vicinity of the heated wire or blade, the wire or blade passes through the foam layer at a point nearer to the foam surface which is in contact with the drum convolution. The convolution on the at least one drum has a height such that transference into the cut foam laminate extends from the outer layer to at least a portion of an abutting layer and forms two convoluted foam layers 102 from the foam layer. In accordance with another exemplary process for forming the convoluted foam layer includes compression cutting, which includes the use of a flatbed compression cutter, i.e., a die template. The compression cutter creates differentiating pressures as the foam drawn through the machine such that cutting forms a mirror image of the template in the foam.

This written description uses examples to disclose the invention, including the best mode, and also to enable any person skilled in the art to make and use the invention. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

What is claimed is:

1. A mattress topper for a mattress assembly comprising:

a single monolithic convoluted foam layer comprising a convoluted upper surface and a bottom planar surface, the convoluted upper surface comprising a planar surface including repeating geometric depressions spaced apart from one another by the planar surface, wherein each of the geometric depressions are defined by an outer geometric-shaped outer wall and a concentric shaped inner wall such that an interior region defined by the concentric shaped inner wall has a surface coplanar to the planar surface.

2. The mattress topper of claim 1, further comprising at least one overlying foam layer comprising a bottom planar surface in contact with the planar surface between the repeating geometric depressions.

3. The mattress topper of claim 1, wherein the repeating geometric depressions comprises a hexagonally shaped outer wall and a circular inner wall.

4. The mattress topper of claim 1, wherein the repeating geometric depressions are arranged in columns and rows, wherein the repeating geometric depressions in one column are offset relative to an adjacent column.

5. The mattress topper of claim 2, wherein the convoluted foam layer and the at least one additional overlying layer have different properties.

6. The mattress topper of claim 5, wherein the different properties comprise differences in indention load deflection, hardness, and/or density.

7. The mattress topper of claim 1, wherein the convoluted foam layer has a hardness from 1 to 25 pounds-force.

8. The mattress topper of claim 2, wherein the convoluted foam layer and the at least one overlying foam layer comprise polyurethane, latex, polystyrene, polyethylene, polypropylene, gel infused foams, or viscoelastic.

9. The mattress topper of claim 2, wherein the convoluted foam layer and the at least one overlying layer further comprise a phase change material and/or a thermally conductive material.

10. The mattress topper of claim 1, wherein the mattress topper is removable relative to the mattress assembly.

11. The mattress topper of claim 1, wherein the mattress topper defines a pillowtop portion of a pillowtop mattress assembly.

12. A mattress topper for a mattress assembly comprising:

a single monolithic convoluted foam layer comprising a convoluted upper surface and a bottom planar surface, the convoluted upper surface comprising a planar surface including a plurality of depressions spaced apart from one another by the planar surface in the convoluted foam layer, wherein each of the plurality of depressions is defined by a hexagonally shaped outer wall and a circular-shaped inner wall; and at least one overlying foam layer comprising a bottom planar surface in contact with the planar surface of the convoluted foam layer.

13. The mattress topper of claim 12, wherein the mattress topper is removable relative to the mattress assembly.

14. The mattress topper of claim 12, wherein the mattress topper defines a pillowtop portion of a pillowtop mattress assembly.

15. The mattress topper of claim 12, wherein the convoluted foam layer and the at least one overlying layer are different foams.

16. The mattress topper of claim 12, wherein the plurality of depressions in the surface of the convoluted foam layer have different configurations in different portions of the convoluted foam layer to define multiple zones in the convoluted foam layer.

17. The mattress topper of claim 12, wherein the convoluted foam layer and the at least one overlying layer have different properties.

18. The mattress topper of claim 12, wherein the circular-shaped inner wall defines a cylindrical shaped foam body having a planar top surface coplanar with the planar surface.

19. A pillowtop mattress comprising:

a pillowtop portion comprising a single monolithic convoluted foam layer comprising a convoluted upper surface and a bottom planar surface, the convoluted upper surface comprising a planar surface including a plurality of depressions spaced apart from one another by the planar surface, wherein each of the plurality of depressions is defined by a hexagonally shaped outer wall and a circular inner wall such that an interior region defined by the circular inner wall has a surface coplanar to the planar surface.

20. The pillowtop mattress of claim 19, further comprising at least one overlying foam layer having planar top and bottom surfaces, wherein the bottom surface is adhesively affixed to the planar surface of the convoluted foam layer.

* * * * *